US008118103B2

(12) United States Patent
Williams

(10) Patent No.: US 8,118,103 B2
(45) Date of Patent: Feb. 21, 2012

(54) DOWNHOLE DRAW-DOWN PUMP AND METHOD

(76) Inventor: Danny T. Williams, Katy, TX (US)

( * ) Notice: Subject to any disclaimer, the term of this patent is extended or adjusted under 35 U.S.C. 154(b) by 373 days.

(21) Appl. No.: 12/423,438

(22) Filed: Apr. 14, 2009

(65) Prior Publication Data

US 2009/0194294 A1 Aug. 6, 2009

Related U.S. Application Data

(63) Continuation-in-part of application No. 12/269,141, filed on Nov. 12, 2008, now abandoned, which is a continuation of application No. 11/801,678, filed on May 10, 2007, now Pat. No. 7,451,824, which is a continuation of application No. 11/447,767, filed on Jun. 6, 2006, now Pat. No. 7,222,675, which is a continuation of application No. 10/659,663, filed on Sep. 10, 2003, now Pat. No. 7,073,597.

(51) Int. Cl.
*E21B 43/00* (2006.01)
*E21B 43/18* (2006.01)

(52) U.S. Cl. ..... 166/372; 166/68; 166/105; 166/311; 166/312; 166/369

(58) Field of Classification Search ..... 166/311, 166/312, 313, 369, 105, 372, 38; 175/213
See application file for complete search history.

(56) References Cited

U.S. PATENT DOCUMENTS

| | | | |
|---|---|---|---|
| 47,793 | A | 5/1865 | Brear |
| 1,693,101 | A | 2/1926 | Worthington |
| 2,290,141 | A | 7/1942 | Burt |
| 2,291,911 | A | 8/1942 | McMahon |
| 2,909,127 | A | 10/1959 | Bradaska |
| 4,074,799 | A | 2/1978 | Hishida et al. |
| 4,135,861 | A | 1/1979 | Brown et al. |
| 4,171,016 | A | 10/1979 | Kempton |
| 4,183,722 | A | 1/1980 | Roeder |
| 4,274,812 | A | 6/1981 | Elvidge et al. |
| 4,275,926 | A | 6/1981 | Hodges |
| 4,285,638 | A | 8/1981 | Clark |
| 4,293,283 | A | 10/1981 | Roeder |
| 4,310,288 | A | 1/1982 | Erickson |
| 4,453,886 | A | 6/1984 | Wilson |
| 4,505,646 | A | 3/1985 | Long et al. |
| 4,536,035 | A | 8/1985 | Huffman et al. |

(Continued)

OTHER PUBLICATIONS

Supp. EU Search Report, Feb. 24, 2010.

*Primary Examiner* — Brad Harcourt
(74) *Attorney, Agent, or Firm* — Jones Walker

(57) ABSTRACT

An apparatus and method for drawing down a fluid level in a well bore. The apparatus and method includes a first tubular disposed within the well bore forming a well bore annulus therein, an annular nozzle connected to an end of the first tubular, and a second tubular concentrically disposed within the first tubular forming a micro annulus. The annular nozzle includes an annular adapter and a suction tube having an internal section and an external section with an outer diameter less than the outer diameter of the first tubular. The external section of the suction tube may be positioned within a restricted section of the well bore, for example, within a restricted well bore section containing a casing liner to drawn down the fluids and solids within the well bore to produce hydrocarbons.

20 Claims, 9 Drawing Sheets

U.S. PATENT DOCUMENTS

| | | | | |
|---|---|---|---|---|
| 4,603,735 | A | 8/1986 | Black | |
| 4,605,069 | A | 8/1986 | McClaflin et al. | |
| 4,630,691 | A | 12/1986 | Hooper | |
| 4,664,603 | A | 5/1987 | Priestly | |
| 4,718,486 | A | 1/1988 | Black | |
| 4,726,420 | A | 2/1988 | Weeks | |
| 4,744,730 | A | 5/1988 | Roeder | |
| 4,790,376 | A | 12/1988 | Weeks | |
| 4,820,131 | A | 4/1989 | Johnson | |
| 4,846,280 | A | 7/1989 | Snider | |
| 4,963,073 | A | 10/1990 | Tash et al. | |
| 5,024,274 | A | 6/1991 | Schwab, Jr. | |
| 5,033,545 | A | 7/1991 | Sudol | |
| 5,080,560 | A | 1/1992 | LeRoy et al. | |
| 5,088,896 | A | 2/1992 | Nielsen et al. | |
| 5,372,190 | A | 12/1994 | Coleman | |
| 5,374,163 | A | 12/1994 | Jaikaran | |
| 5,435,628 | A | 7/1995 | Montgomery et al. | |
| 5,488,993 | A | 2/1996 | Hershberger | |
| 5,707,214 | A | 1/1998 | Schmidt | |
| 5,716,006 | A | 2/1998 | Lott | |
| 5,743,717 | A | 4/1998 | Schmidt | |
| 5,788,464 | A | 8/1998 | Gabelgaard | |
| 5,806,599 | A | 9/1998 | Hisaw et al. | |
| 6,146,105 | A | 11/2000 | Williams | |
| 6,209,641 | B1 * | 4/2001 | Stevenson | 166/266 |
| 6,354,371 | B1 | 3/2002 | O'Blanc | |
| 6,382,321 | B1 | 5/2002 | Bates et al. | |
| 6,450,775 | B1 | 9/2002 | Hutchinson et al. | |
| 6,511,041 | B2 | 1/2003 | Faustinelli | |
| 6,543,534 | B2 | 4/2003 | Erick | |
| 2001/0025651 | A1 | 10/2001 | Almeida | |
| 2002/0029888 | A1 | 3/2002 | Swensen | |
| 2002/0070369 | A1 | 6/2002 | Faustinelli | |
| 2002/0134554 | A1 | 9/2002 | Schrenkel et al. | |
| 2002/0139525 | A1 | 10/2002 | Erick | |
| 2004/0104023 | A1 | 6/2004 | Stark et al. | |

* cited by examiner

DOWNHOLE DRAW-DOWN PUMP AND METHOD

I. CROSS-REFERENCE TO RELATED APPLICATIONS

This application is a continuation-in-part of U.S. patent application Ser. No. 12/269,141, filed Nov. 12, 2008 now abandoned , which is a continuation of U.S. patent application Ser. No. 11/801,678, filed May 10, 2007, now issued as U.S. Pat. No. 7,451,824, which is a continuation of U.S. patent application Ser. No. 11/447,767, filed Jun. 6, 2006, now issued as U.S. Pat. No. 7,222,675, which is a continuation of U.S. patent application Ser. No. 10/659,663, filed Sep. 10, 2003, now issued as U.S. Pat. No. 7,073,597.

II. BACKGROUND OF THE INVENTION

A. Technical Field

The present invention relates to a down-hole pump. More particularly, but not by way of limitation, this invention relates to a downhole draw-down pump used to withdraw fluid from a well bore and method.

B. Background Art

In the production of oil and gas, a well is drilled in order to intersect a hydrocarbon bearing deposit, as is well understood by those of ordinary skill in the art. The well may be of vertical, directional, or horizontal contour. Also, in the production of natural gas, including methane gas, from coal bed seams, a well bore is drilled through the coal bed seam, and methane is produced via the well bore.

Water encroachment with these natural gas and oil deposits is a well documented problem. Once water enters the well bore, production of the hydrocarbons can be severely hampered due to several reasons including the water's hydrostatic pressure effect on the in-situ reservoir pressure. Down hole pumps have been used in the past in order to draw down the water level. However, prior art pumps suffer from several problems that limit the prior art pump's usefulness. This is also true of well bores drilled through coal beds. For instance, in the production of methane from coal bed seams, a sump is often times drilled that extends past the natural gas deposit. Hence, water can enter into this sump. Water encroachment can continue into the well bore, and again the water's hydrostatic pressure effect on the in-situ coal seam pressure can cause termination of gas production. As those of ordinary skill will recognize, for efficient production, the water in the sump and well bore should be withdrawn, Also, rock, debris and formation fines can accumulate within this sump area and operators find it beneficial to withdraw the rock and debris.

Therefore, there is a need for a downhole draw-down pump that can be used to withdraw a fluid contained within a well bore that intersects a natural gas and oil deposit. These, and many other needs, will be met by the invention herein disclosed.

III. SUMMARY OF THE INVENTION

An apparatus for use in a well bore is disclosed. The apparatus comprises a first tubular disposed within the well bore so that a well bore annulus is formed therein, and wherein the first tubular has a distal end and a proximal end. The apparatus further includes an annular nozzle operatively attached to the distal end of the first tubular, and wherein the annular nozzle comprises: an annular adapter; and, a suction tube that extends from the annular adapter into an inner portion of the first tubular. In one embodiment, the suction tube may be threadedly attached to the annular adapter.

The apparatus further comprises a second tubular concentrically disposed within the first tubular so that a micro annulus is formed therein, and wherein a first end of the second tubular is positioned adjacent the suction tube so that a restricted area is formed within an inner portion of the second tubular.

The apparatus may further contain jet means, disposed within the first tubular, for delivering an injected medium from the micro annulus into the well bore annulus. Also, the apparatus may include stabilizer means, disposed about the second tubular, for stabilizing the second tubular within the first tubular. The apparatus may further contain an inner tubing restriction sleeve disposed within the inner portion of the second tubular, and wherein the inner tubing restriction sleeve receives the suction tube.

Additionally, the apparatus may include means, located at the surface, for injecting the injection medium into the micro annulus. The injection medium may be selected from the group consisting of gas, air, or fluid.

In one of the preferred embodiments, the well bore intersects and extends past a coal bed methane gas seam so that a sump portion of the well bore is formed. Also, in one of the preferred embodiments, the apparatus is placed below the coal bed methane gas seam in the sump portion. In another embodiment, the apparatus may be placed within a well bore that intersects subterranean hydrocarbon reservoirs.

The invention also discloses a method of drawing down a fluid column from a well bore, and wherein the well bore intersects a natural gas deposit. The method comprises providing a first tubular within the well bore so that a well bore annulus is formed therein, the first tubing member having an annular nozzle at a first end. The annular nozzle contains an annular adapter that is connected to a suction tube, and wherein the suction tube extends into an inner portion of the first tubular.

The method includes disposing a second tubular concentrically within the first tubular so that a micro annulus is formed, and wherein a first end of the second tubular is positioned about the suction tube. A medium is injected into the micro annulus which in turn causes a zone of low pressure within the suction tube. Next, the fluid contained within the well bore annulus is suctioned into the suction tube. The fluid is exited from the suction tube into an inner portion of the second tubular, and wherein the fluid is mixed with the medium in the inner portion of the second tubular. The fluids, solids and medium are then discharged at the surface.

In one embodiment, the method may further comprise injecting the medium into the well bore annulus and mixing the medium with the fluid within the well bore annulus. Then, the medium and fluid is forced into the suction tube.

The method may also include lowering the level of the fluid within the well bore annulus, and flowing the natural gas into the well bore annulus once the fluid level reaches a predetermined level. The natural gas in the well bore annulus can then be produced to a surface collection facility.

In another preferred embodiment, a portion of the medium is jetted from the micro annulus into the well bore annulus, and the medium portion is mixed with the fluid within the well bore annulus. The medium and fluid is forced into the suction tube. The level of the fluid within the well bore annulus is lowered. The injection of the medium into the micro annulus is terminated once the fluid level reaches a predetermined level. The natural gas can then be produced into the well bore annulus which in turn will be produced to a surface collection facility.

In one of the preferred embodiments, the well bore contains a sump area below the level of the natural gas deposit and wherein the suction member is positioned within the sump area. Additionally, the natural gas deposit may be a coal bed methane seam, or alternately, a subterranean hydrocarbon reservoir.

In an alternative embodiment of the present invention an apparatus for suctioning fluids and solids from a well bore is provided. The apparatus includes a first tubular member disposed within the well bore forming a well bore annulus therein. The first tubular member has a first end and an inner portion. The apparatus also includes a suction tube having an inner portion with an unobstructed circular flow area for passage of the fluids and solids within the well bore annulus, an outer portion, an internal section, and an external section. The internal section of the suction tube extends into the inner portion of the first tubular member. The external section of the suction tube extends external of the first tubular member within a restricted section of the well bore. The apparatus also includes a second tubular member concentrically disposed within the first tubular member forming a micro annulus therein for injection of a power fluid. The second tubular member has a first end and an inner portion. The first end of the second tubular member is concentrically positioned about the outer portion of the suction tube at the internal section thereof forming an annular passage within the inner portion of the second tubular member for passage of the power fluid.

In the alternative embodiment, the external section of the suction tube has an outer diameter in the range of 2 inches to 4 inches or smaller or larger. The external section of the suction tube has a length in the range of 1500 feet to 3000 feet or shorter or longer. The suction tube may comprise a plurality of tube segments threadedly connected together.

In the alternative embodiment, the restricted section of the well bore is formed by a casing liner affixed within the well bore, an open hole well bore smaller than the outside diameter of the first tubular member, or multiple well bores smaller than the OD of the first tubular member.

In the alternative embodiment, the apparatus may further include an annular adapter having an outer wall and an inner wall. The outer wall of the annular adapter may be threadedly connected to the first end of the first tubular member. The inner wall of the annular adapter may be threadedly connected to the suction tube at the internal section thereof.

In the alternative embodiment, the apparatus may also include a stabilizer means disposed about the second tubing member. The stabilizer means stabilizes the second tubing member within the first tubing member.

In the alternative embodiment, the apparatus may include a jet means disposed within the first tubular member. The jet means delivers an injected power fluid from the micro annulus into the well bore annulus.

In the alternative embodiment, the apparatus may further include an inner tubing restriction sleeve disposed within the second tubular member. A portion of the internal section of the suction tube extends into the inner tubing restriction sleeve.

In the alternative embodiment, the apparatus may also include an injection means. The injection means may be located at the well-bore surface for injecting the power fluid into the micro annulus. The power fluid may be a gas, air, or a liquid.

An alternative embodiment of the method of the present invention involves drawing down fluids and solids in a well bore. The well bore intersects a hydrocarbon deposit having a hydrocarbon, e.g., a natural gas or oil deposit having natural gas or oil. The alternative method includes the step of providing an assembly comprising: a first tubular member, the first tubular member having a first end and an inner portion; a suction tube having an inner portion with an unobstructed circular flow area for passage of the fluids and solids within a well bore annulus, an outer portion, an internal section, and an external section, the internal section of the suction tube extending into the inner portion of the first tubular member, the external section of the suction tube extending external of the first tubular member. The alternative method includes the step of disposing the assembly within the well bore. The first tubular member forms the well bore annulus in the well bore when disposed therein. The external section of the suction tube extends within a restricted section of the well bore. The alternative method includes the step of disposing a second tubular member concentrically within the first tubular member forming a micro annulus therein for injection of a power fluid. The second tubular member has a first end and an inner portion. The first end of the second tubular member is concentrically positioned about the outer portion of the suction tube at the internal section thereof forming an annular passage within the inner portion of the second tubular member for passage of the power fluid. The alternative method also includes injecting the power fluid into the micro annulus. The alternative method further includes channeling the power fluid through the annular passage. The alternative method includes causing an area of low pressure within the suction tube and drawing down the fluids and solids contained within the well bore annulus (and in the well bore containing the casing liner) into the suction tube. The alternative method includes discharging the fluids and solids from the suction tube into the inner portion of the second tubular member and mixing the fluids and solids with the power fluid in the inner portion of the second tubular member. The alternative method includes discharging the mixture of the fluids, solids, and power fluid at a surface of the well bore.

The alternative method may include the additional steps of flowing the hydrocarbon from the hydrocarbon deposit (e.g., natural gas or oil from the natural gas or oil deposit) into the well bore annulus once a level of the fluids and solids in the well bore annulus is reduced to a predetermined level and producing the hydrocarbon (e.g., natural gas or oil) in the well bore annulus to a surface collection facility.

In the alternative method, the external section of the suction tube has an outer diameter in the range of 2 inches to 4 inches or smaller or larger. The external section of the suction tube has a length in the range of 1500 feet to 3000 feet or shorter or longer. The suction tube may comprise a plurality of tube segments threadedly connected together.

In the alternative method, the restricted section of the well bore is formed by a casing liner affixed within the well bore, an open hole well bore smaller than the outside diameter of the first tubular member, or multiple well bores smaller than the OD of the first tubular member.

In the alternative method, the well bore contains a sump area below a level of the hydrocarbon deposit (e.g., natural gas or oil deposit) and a portion of the external section of the suction tube is positioned within the sump area. The hydrocarbon deposit may be a natural gas or oil deposit and more particularly a coal-bed-methane seam or other hydrocarbon seam. The power fluid may be a gas, air, or a liquid.

An advantage of the present invention is the novel annular nozzle. Another advantage of the present invention includes the apparatus herein disclosed has no moving parts. Another advantage is that the apparatus and method will draw down fluid levels within a well bore. Another advantage is that the apparatus and method will allow depletion of low pressure wells, or wells that have ceased production due to insufficient in-situ pressure, and/or pressure depletion.

Yet another advantage is that the apparatus and method provides for the suctioning of fluids and solids. Another advantage is it can be run in vertical, directional, or horizontal well bores. Another advantage is a wide range of suction discharge can be implemented by varying medium injection rates. Another advantage is that the device can suction from the well bore both fluids as well as solids.

A feature of the present invention is that the annular nozzle provides for an annular flow area for the power fluid. Another feature of the invention is that the annular nozzle includes an annular adapter and suction tube and wherein the annular adapter is attached to a tubular member, with the annular adapter extending to the suction tube. Another feature is use of a restriction adapter sleeve disposed on an inner portion of a second tubular member. Yet another feature is that the restriction sleeve may be retrievable.

Another feature includes use of jets that are placed within the outer tubular member to deliver an injection medium to the well bore annulus. Yet another feature is that the jets can be placed in various positions and directed to aid in evacuating the well bore annulus. Still yet another feature is that the suction tube may contain a check valve to prevent a back flow of fluid and/or solids.

A feature of the alternative embodiment of the present invention is the ability to operate within a well bore having a restricted ID (inner diameter).

An additional feature of the alternative embodiment of the present invention is the capability to operate (e.g., create a suction) below a position where the medium injection pressure exceeds the maximum surface injection pressure.

IV. BRIEF DESCRIPTION OF THE SEVERAL VIEWS OF THE DRAWINGS

V. DETAILED DESCRIPTION OF THE INVENTION

Figure 1:
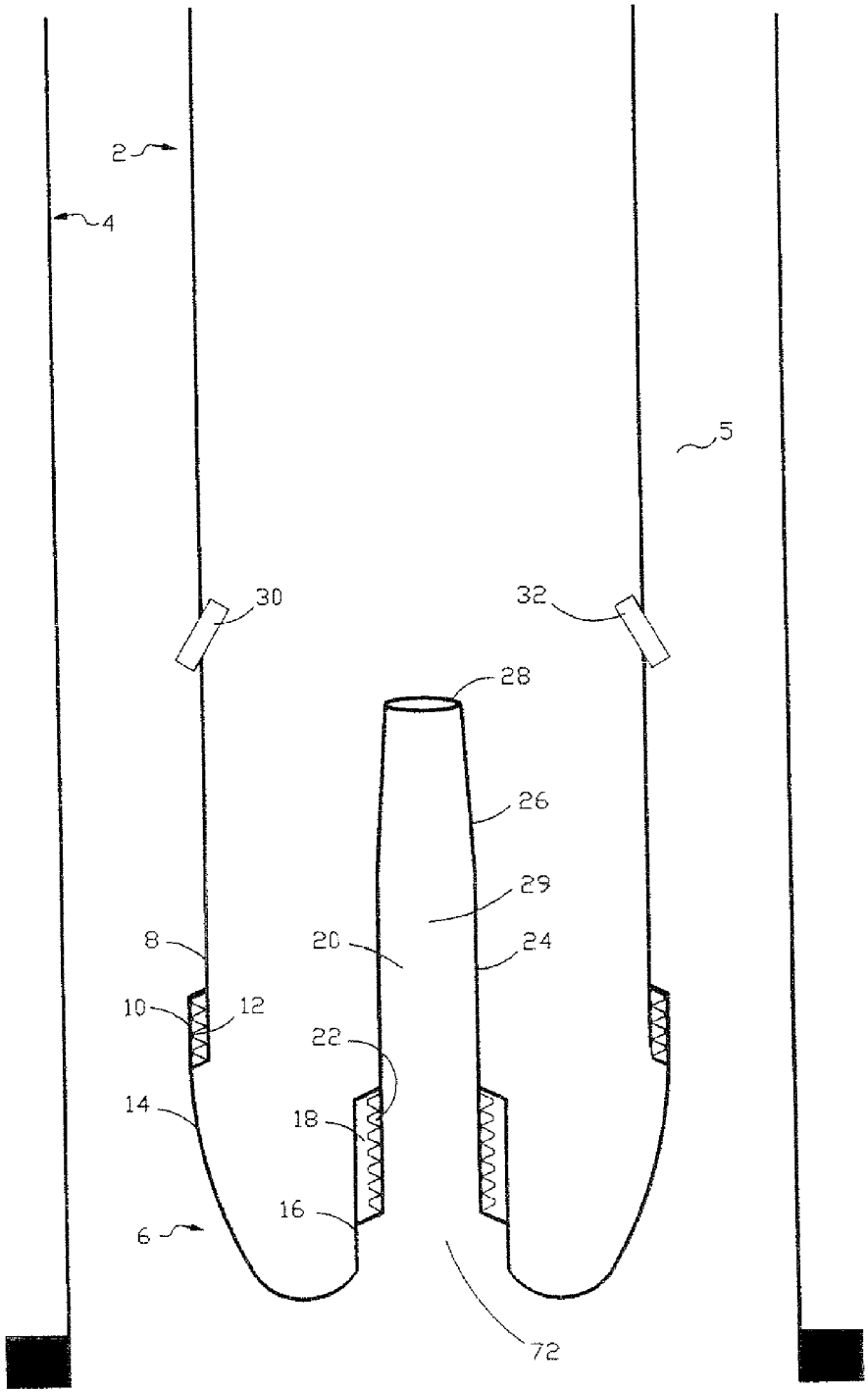
FIG. 1 depicts a first tubular member with suction member disposed within a well bore.

Referring now to FIG. 1, a first tubular member 2 is shown concentrically disposed into a well bore 4. As used herein, a well bore can be a bore hole, casing string, or other tubular. In the most preferred embodiment, the well bore 4 is a casing string. The first tubular member 2 has been lowered into the well bore 4 using conventional means such as by coiled tubing, work string, drill string, etc. In one of the preferred embodiments, the well bore extends below the surface and will intersect various types of subterranean reservoirs and/or mineral deposits. The well bore is generally drilled using various types of drilling and/or boring devices, as readily understood by those of ordinary skill in the art.

The first tubular member 2 disposed within the well bore 4 creates a well bore annulus 5. The well bore 4 may be a casing string cemented into place or may simply be a drilled bore hole or other tubing. It should be noted that while a vertical well is shown in the figures, the well bore 4 may also be of deviated, directional or horizontal contour.

The first tubular member 2 will have an annular nozzle that comprises an annular adapter and a suction tube. More specifically, the annular adapter 6 is attached to the second end 8 of the first tubular member 2. In the preferred embodiment, the annular adapter 6 contains thread means 10 that make-up with the thread means 12 of the first tubular member 2. The annular adapter 6 has a generally cylindrical outer surface 14 that has a generally reducing outer surface portion which in turn extends radially inward to inner portion 16. The inner portion 16 has thread means 18. The suction tube 20 will extend from the annular adapter 6. More specifically, the suction tube 20 will have thread means 22 that will cooperate with the thread means 18 in one preferred embodiment and as shown in FIG. 1. The suction tube 20 has a generally cylindrical surface 24 that then extends to a conical surface 26, which in turn terminates at the orifice 28. The orifice 28 can be sized for the pressure draw down desired by the operator at that point. The suction tube has an inner portion 29. Note that FIG. 1 shows the opening 72 of the annular adapter 6.

FIG. 1 further depicts a plurality of jets. More specifically, the jet 30 and jet 32 are disposed through the first tubular member 2. The jets 30, 32 are positioned so to direct a stream into the well bore annulus 5. The jets are of nozzle like construction and are positioned in opposite flow directions, at different angles, and it is also possible to place the jets in different areas on member 2 in order to aid in stirring the fluid and solids within the well bore annulus. Jets are usually sized small in order to take minimal flow from the micro annulus (as described below).

Figure 2:
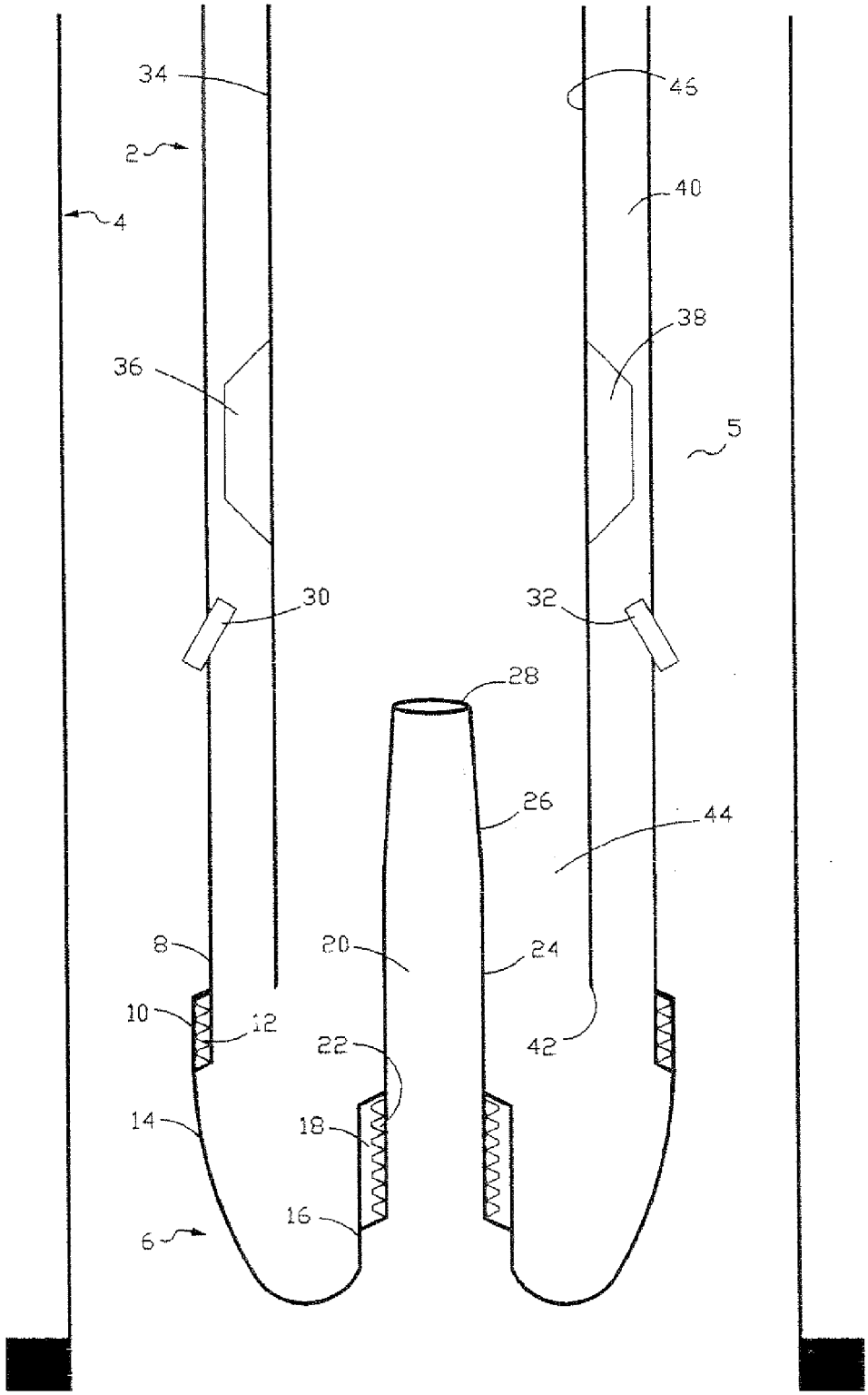
FIG. 2 depicts a second tubular member having been concentrically disposed within the first tubular member of FIG. 1.

Referring now to FIG. 2, a second tubular member 34 is shown having been concentrically disposed within the first tubular member 2 of FIG. 1. It should be noted that like numbers appearing in the various figures refer to like components. Thus, the second tubular member 34 has been concentrically lowered into the inner portion of the first tubular member 2 via conventional means, such as by coiled tubing, work string, drill string, etc. The second tubular member 34 will have stabilizer means 36 and 38. The stabilizer means 36, 38 may be attached to the outer portion of the second tubular member 34 by conventional means such as by welding, threads, etc. The stabilizer means may be a separate module within the second tubular member 34. In one embodiment, three stabilizer means are disposed about the outer portion of the second tubular member 34. As shown in FIG. 2, the stabilizer means are attached to the second tubular member 34. Additionally, the stabilizer means 36, 38 can be placed on the second tubular member 34 at any position, direction and/or angle needed to stabilize second tubular member 34 over suction tube 20.

Once the second tubular member 34 is concentrically positioned within the first tubular member 2, a micro annulus 40 is formed. The second tubular member 34 is placed so that the suction tube 20 extends past an end 42 of the second tubular member 34. As will be discussed in further detail later in the application, a medium is injected into the micro annulus 40, and wherein the medium will be directed about the end 42 into the passage 44 and up into the inner diameter portion 46 of the second tubular member 34. Note that the passage 44 is formed from the suction tube being disposed within the second tubular member 34. The passage 44 represents an annular flow area of the annular nozzle that the medium traverses through.

Figure 3:
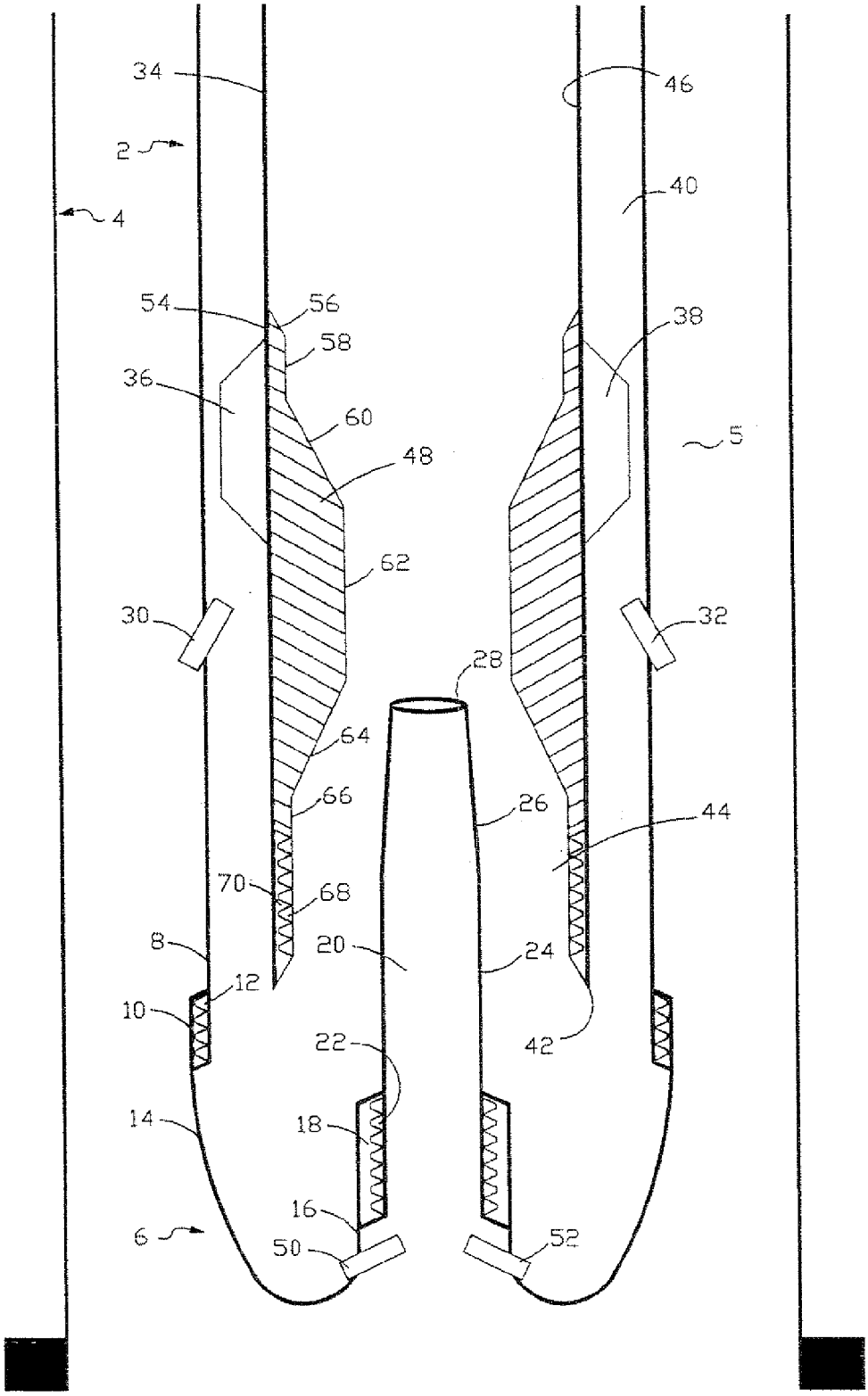
FIG. 3 depicts a second embodiment of the apparatus illustrated in FIG. 2.

Referring now to FIG. 3, a second embodiment of the apparatus illustrated in FIG. 2 will now be described. More specifically, an inner tubing restriction sleeve 48 has been added to the inner portion 46 of the second tubular member 34. FIG. 3 also shows two additional jets, namely jet 50 and jet 52. The jets are of nozzle like construction. The jets may be placed in varying positions and/or angle orientation in order to lift the well bore fluids and solids to the surface. The position and/or angle orientation of the jets is dependent on specific well bore configurations, flow characteristics, and other design characteristics. The jets 50, 52 are positioned to direct a portion of the micro annulus injection medium exiting the jets 50, 52 into the bottom of the suction tube 20.

The inner tubing restriction sleeve 48 has an outer diameter portion 54 that will cooperate with the inner diameter portion 46 of the second tubular member 34. Extending radially inward, the sleeve 48 has a first chamfered surface 56 that extends to an inner surface 58 which in turn extends to conical surface 60. The conical surface 60 then stretches to radial surface 62 which in turn extends to the conical surface 64 which then stretches to the radial surface 66. FIG. 3 further depicts thread means 68 on the restriction sleeve 48 that will cooperate with thread means 70 on the second tubular member 34 for connection of the restriction sleeve 48 to the second tubular member 34. Other means for connecting are possible, such as by welding, or simply by making the restriction sleeve integral with the second tubular member 34. It should be noted that the inner diameter portion of the restriction sleeve 48 can vary in size according to the various needs of a specific application. In other words, the inner diameter of the restriction sleeve 48 can be sized based on the individual well needs such as down-hole pressure, fluid density, solids content, etc. In FIG. 3, the passage 44 is formed between the restriction sleeve 48 and the suction tube 20.

Figure 4:
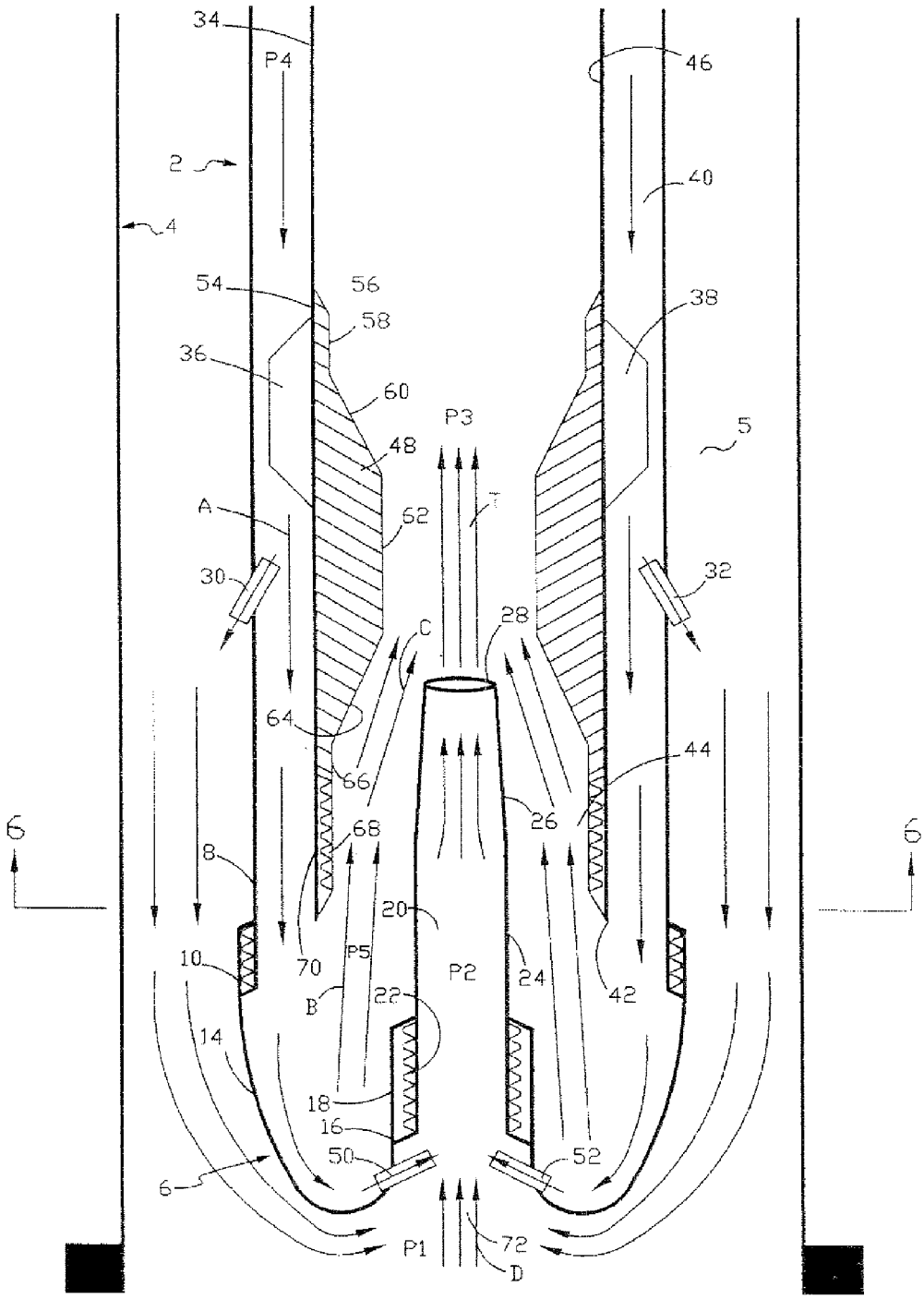
FIG. 4 depicts the embodiment illustrated in FIG. 3 with flow lines to depict the flow pattern within the draw-down pump and from the well bore.

Reference is now made to FIG. 4, and wherein FIG. 4 depicts the embodiment illustrated in FIG. 3 with flow lines to depict the flow pattern within the draw-down pump and from well bore 4. The operator would inject a medium, such as gas, air, or fluid, into the micro annulus 40. The medium will generally be injected from the surface. The medium, sometimes referred to as a power fluid, proceeds down the micro annulus 40 (as seen by the arrow labeled "A") and into the annular nozzle. More specifically, the medium will flow around the end 42 and in turn into the passage 44 (see arrow "B"). Due to the suction tube 20 as well as the restriction sleeve 48, the flow area for the injected medium has been decreased. This restriction in flow area will in turn cause an increase in the velocity of the medium within the passage 44. As the medium continues, a further restriction is experienced once the medium flows past the conical surface 64 (see arrow "C"), and accordingly, the velocity again increases. The velocities within the passage 44 and immediately above the orifice 28 would have also increased. The pressure within the suction tube 20, however, will be experiencing suction due to the venturi effect. The pressure P1 is greater than the pressure at P2 which causes flow into, and out of, the suction tube 20. As noted earlier, the orifice 28 and/or restriction sleeve 48 can be sized to create the desired pressure draw down. Hence, the fluid and solids contained within the well bore annulus 5 will be suctioned into the suction tube 20 via opening 72. The suction thus created will be strong enough to suction fluids and solids contained within the well bore annulus 5 (see arrow "D"). Once the fluid and solids exit the orifice 28, the fluid and solids will mix and become entrained with the medium within the throat area denoted by the letter "T" and will be carried to the surface together with the injection media.

The jets 30, 32 will also take a portion of the medium injected into the micro annulus 40 and direct the medium into the well bore annulus 5. This will aid in mixing and moving the fluid and solids within the well bore annulus 5 into the suction tube 20. FIG. 4 also depicts the jets 50, 52 that will direct the medium that has been injected into the micro annulus into the suction tube 20. Again, this will aid in stirring the annular fluid and solids, and causing suction at the opening 72 and aid in directing the fluid and/or solids into the suction tube 20.

According to the teachings of this invention, it is also possible to place a check valve (not shown) within the suction tube 20. The check valve would prevent the fluid and solids from falling back down. Also, it is possible to make the restriction sleeve 48 retrievable so that the restriction sleeve 48 could be replaced due to the need for a more appropriate size, wear, and/or general maintenance. Moreover, the invention may include placement of an auger type of device (not shown) which would be operatively associated with the annular adapter 6. The auger means would revolve in response to the circulation of the medium which in turn would mix and crush the solids.

Figure 5:
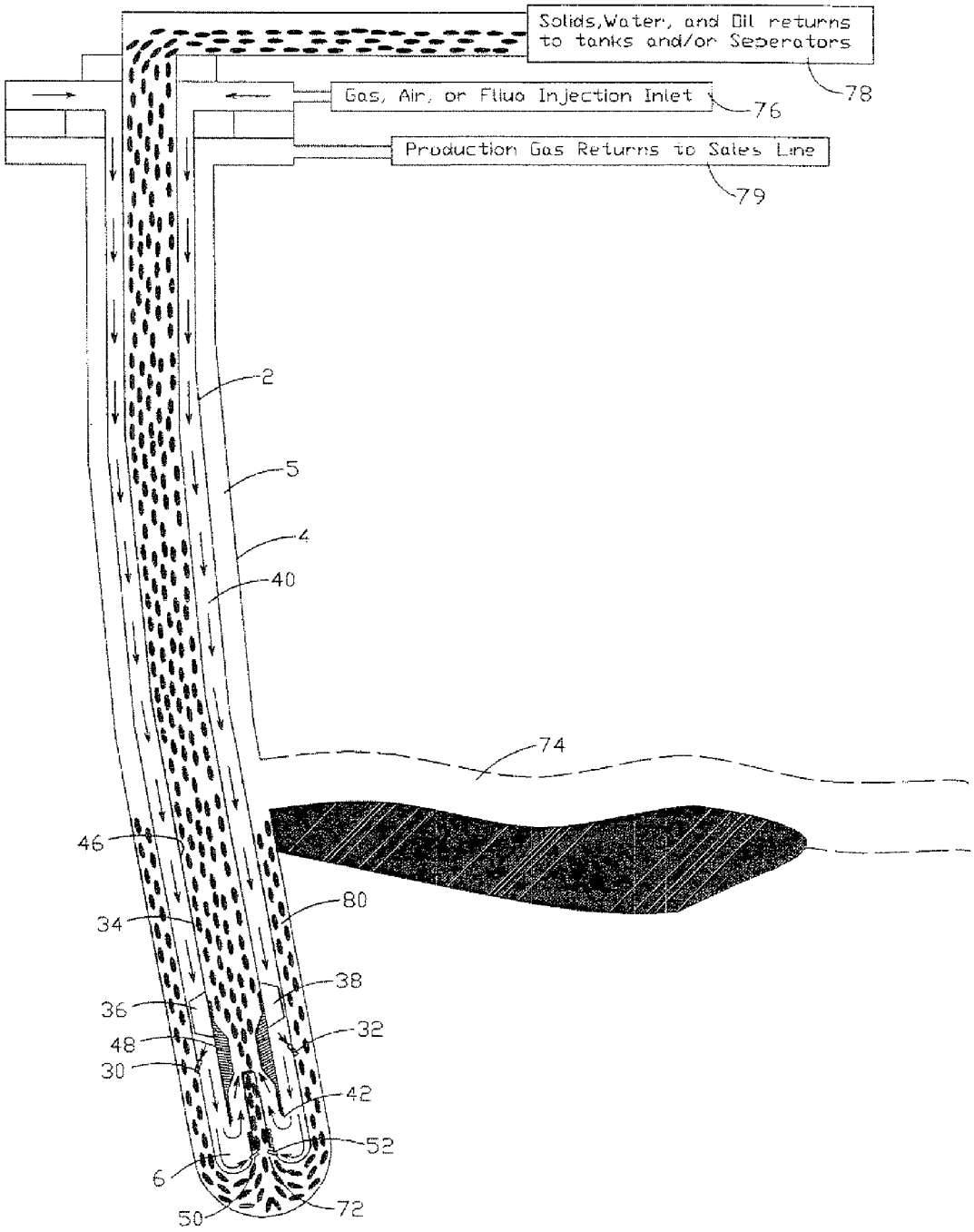
FIG. 5 is a schematic illustration of the apparatus of the present invention in use in a well bore.

Referring now to FIG. 5, a schematic illustration of one of the preferred embodiments of the apparatus of the present invention in use in a well bore will now be described. More specifically, the well bore 4 intersects a natural gas deposit. In FIG. 5, the natural gas deposit is a coal bed methane seam. In the case of a coal bed methane seam, and as those of ordinary skill will recognize, a bore hole 74 is drilled extending from the well bore 4. As shown in FIG. 5, the bore hole 74 is essentially horizontal, and the bore hole 74 may be referred to as a drainage bore hole 74. The methane gas embedded within the coal bed methane seam will migrate, first, to the drilled bore hole 74 and then, secondly, into the well bore 4. It should be noted that the invention is applicable to other embodiments. For instance, the natural gas deposit may be a subterranean hydrocarbon reservoir. In the case where the natural gas deposit is a subterranean hydrocarbon reservoir, there is no requirement to drill a drainage bore hole. The in-situ hydrocarbons will flow into the well bore annulus 5 due to the permeability of the reservoir. Hence, the invention herein described can be used in coal bed methane seams as well as traditional oil and gas subterranean reservoirs.

The annular adapter 6 is shown attached to the first tubular member 2. The suction tube 20 extends into the second tubular member 34 and inner tubing restriction sleeve 48 as previously noted. The medium is injected from the surface from a generator means 76 such as a fluid pump or compressor means. The medium is forced (directed) down the well bore 4. As noted earlier, the medium flowing through the annular nozzle will in turn cause suction within the opening 72 so that the fluid and solids that have entered into the well bore 4 can be withdrawn.

The fluid and solids that enter into the inner portion 46 of the second tubular member 34 will be delivered to separator means 78 on the surface for separation and retention. As the fluid is drawn down to a sufficient level within the well bore 4, gas can migrate from the natural gas deposit into the well bore 4. The gas can then be produced to the surface (via well bore annulus 5) to production facility means 79 for storage, transportation, sale, etc.

As seen in FIG. 5, the well bore 4 contains a sump area 80. Thus, in one embodiment, the sump area 80 can collect the fluid and solids which in turn will be suctioned from the well bore 4 with the novel apparatus herein disclosed. The fluid level is drawn down thereby allowing the gas from the deposit to enter into the well bore 4 for production to the surface. If the subterranean mineral deposit is pressure deficient or is subject to water encroachment, then water may migrate back into the well bore, and into the sump. The water level can rise within the well bore 4, thereby reducing or shutting-off gas production. Once the water rises to a sufficient level so that gas production is interrupted, then, and according to the teachings of the present invention, the fluid level can be drawn down using the suction method and apparatus herein disclosed, and production can be restored. Also, the pump can continuously run to maintain a certain fluid height within well bore 4 that will allow a certain gas production rate. This can be repeated indefinitely or until the subterranean mineral deposit is depleted.

It should also be noted that it is possible to also inject the injection medium down the well bore annulus 5. Hence, the operator could inject into both the micro annulus 40 and well bore annulus 5, or either, depending on conditions and desired downhole effects.

Figure 6:
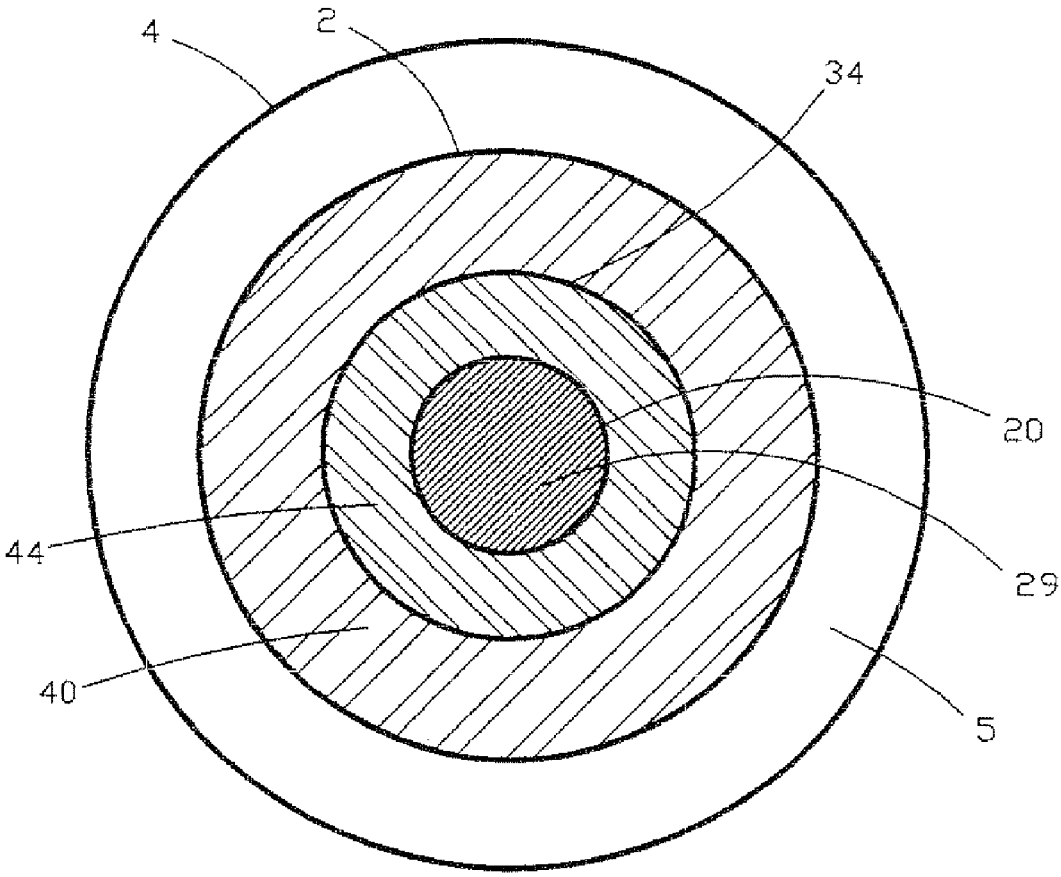
FIG. 6 is a cross sectional view of the apparatus taken from line 6-6 of FIG. 4.

FIG. 6 is a cross sectional view of the apparatus taken from line 6-6 of FIG. 4. In the view of FIG. 6, the well bore annulus 5 is shown. The micro annulus 40 is shown, and as previously described, the medium (power fluid) is injected down the micro annulus. FIG. 6 also shows the passage 44, which is formed due to the configuration of the annular nozzle, and wherein the passage 44 represents an annular flow area for passage of the power fluid. The suction tube's inner portion is seen at 29 and wherein the fluid and solids being suctioned into the suction tube's inner portion 29 is being drawn from the well bore annulus 5.

As understood by those of ordinary skill in the art, a stream that exits a restriction will have considerable kinetic energy associated therewith, and wherein the kinetic energy results from a pressure drop generated by the restriction. Generally, the sizing of the restriction determines the pressure drop, and a desired pressure drop can be caused by varying the size of passage 44. This can be accomplished by varying the diameter of the restriction sleeve which reduces flow area, increase velocity and in turn affects a pressure drop. As noted earlier, a portion of FIG. 6 depicts the flow area created due to placement of the restriction sleeve 48. Hence, if the restriction sleeve 48 inner diameter portion is enlarged, then the effective area of the passage 44 would be reduced thereby increasing the pressure drop. By the same token, the size of the suction tube 20 walls could be enlarged, thereby reducing the effective flow area which in turn would cause an increase pressure drop.

Figure 7:
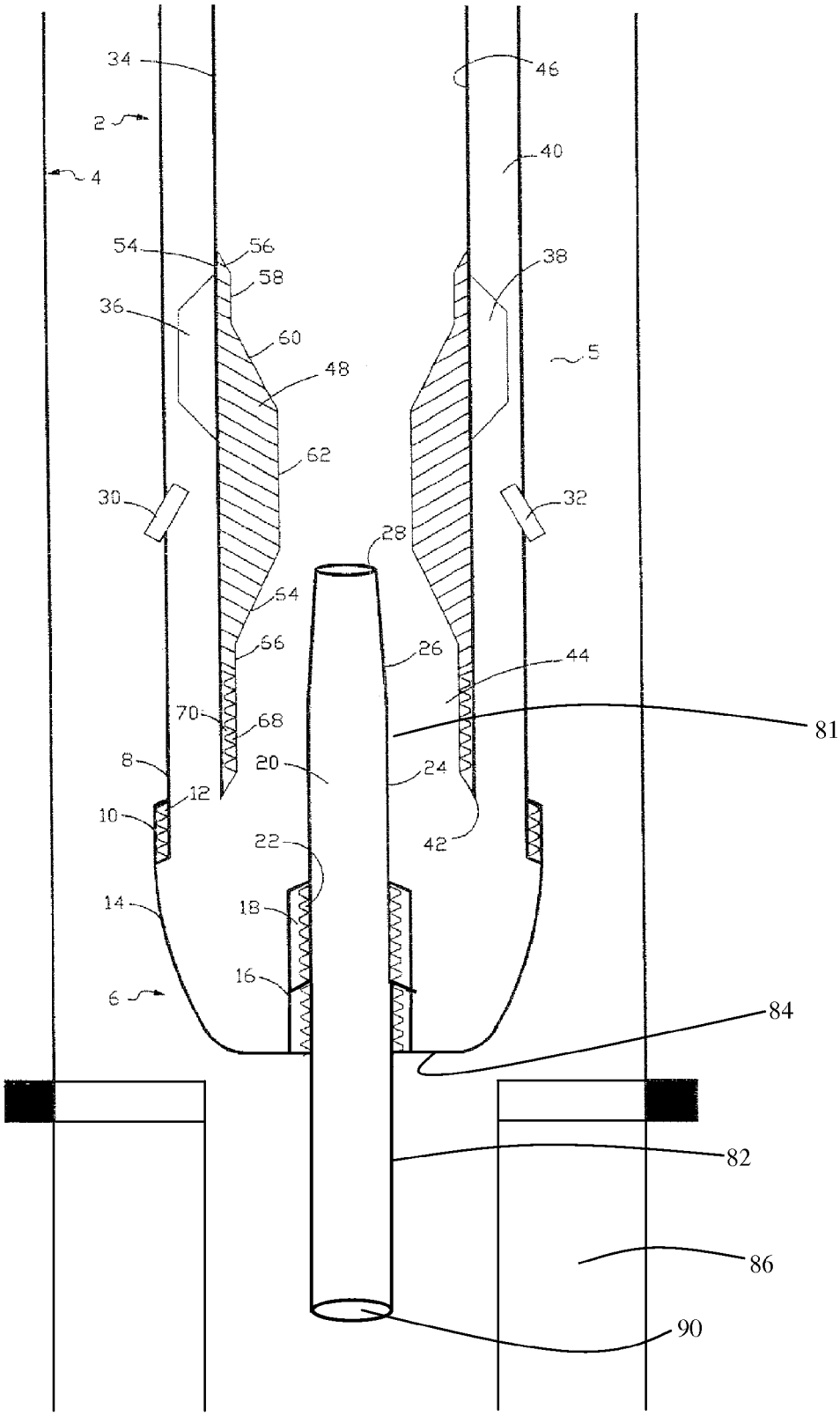
FIG. 7 depicts an alternative embodiment of the apparatus of the present invention.

The embodiments of the apparatus of the present invention described above are drawn to a downhole draw-down pump with a reverse jet venturi design to be used in vertical, directional, and horizontal well bores. The purpose of the apparatus is to provide a mechanical means powered at the surface to create a pressure drop at the bottom of the apparatus (e.g., within tubular member 2) that causes suction inside well bore 4. The suction lifts production fluids and formation fines (e.g., solids) to the surface via the power fluid used at the surface to power the pressure drop created at the bottom of the apparatus. The apparatus is operational in a well bore having an ID (inner diameter) that exceeds the OD (outer diameter) of the apparatus (e.g., the OD of tubular member 2). Accordingly, if a well bore has a restricted ID, such as when a casing liner is affixed to a section of the well bore, the apparatus can only be run downhole to a position directly above the start o the casing liner where the restriction begins. The apparatus cannot be run within the casing liner because the OD of the apparatus exceeds the ID of the casing liner. Additionally, the apparatus can only be run down the well bore to a position where the down-hole pressure does not exceed the maximum injection pressure of the surface equipment providing the power or drive fluid. The alternative embodiment of the apparatus of the present invention shown in FIG. 7 is able to operate within a well bore having a restricted ID. The alternative apparatus is further able to operate below a position where the pressure exceeds the maximum injection pressure.

With reference to FIG. 7, the alternative embodiment may include suction tube 20 having an internal section 81 and an external section 82. Section 82 extends longitudinally from bottom 84 of adapter 6. In FIG. 7, section 82 of tube 20 extends downhole within casing liner 86. Section 82 extends the pressure drop and suction of the apparatus within well bore 4 from bottom 84 of adapter 6 (or second end 8 of first tubular member 2) to inlet 90 of tube 20. Section 82 may be comprised of two or more tubular segments or sections threadedly connected together. The OD of section 82 may vary. For example, the OD of section 82 may be in the range of 2" to 4" or from 2⅜" to 2½" or smaller or larger. The length of section 82 may also vary. For example, section 82 may have a length in the range of 1500 feet to 3500 feet or shorter or larger. With the addition of section 82, an operator can create the pressure drop inside the apparatus at any compatible well bore minimum ID depth. The alternative embodiment also alleviates any injection pressure problems by setting tubular member 2 at an acceptable injection pressure depth and by letting section 82 extend the pressure drop and suction deeper into well bore 4, such as for example, within casing liner 86.

Figure 8:
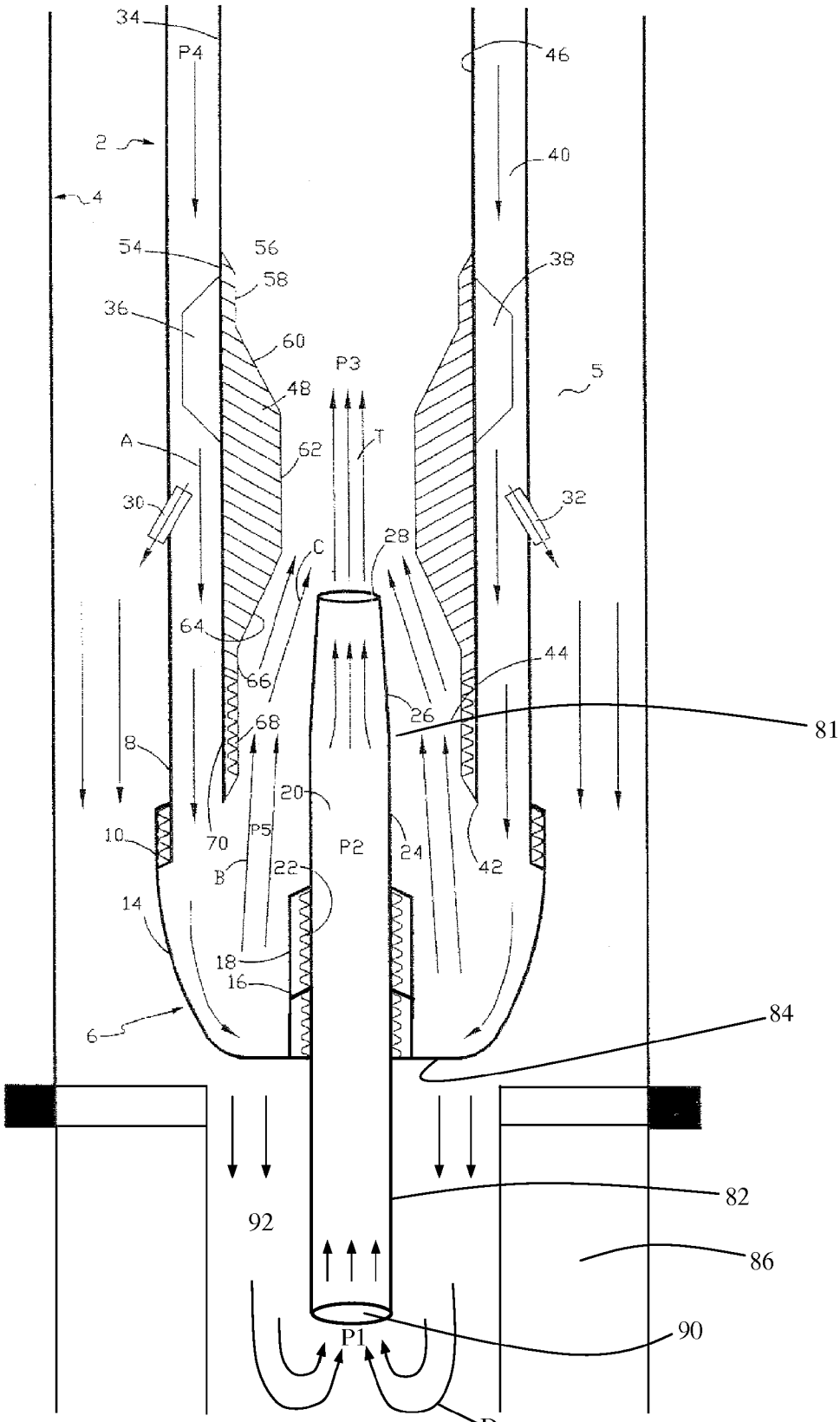
FIG. 8 depicts the alternative embodiment illustrated in FIG. 7 with flow lines to depict the flow pattern within the draw-down pump and from the well bore.

FIG. 8 depicts the alternative embodiment illustrated in FIG. 7 with flow lines to depict the flow pattern within well bore 4. The operator would inject a medium, such as gas, air, or liquid, into micro annulus 40. The medium will generally be injected from the surface. The medium or power fluid proceeds down micro annulus 40 (as seen by the arrow labeled "A") and into the annular nozzle. More specifically, the medium will flow around end 42 and in turn into passage 44 (see arrow "B"). Due to suction tube 20 as well as restriction sleeve 48, the flow area for the injected medium has been decreased. This restriction in flow area will in turn cause an increase in the velocity of the medium within passage 44. As the medium continues, a further restriction is experienced once the medium flows past conical surface 64 (see arrow "C"), and accordingly, the velocity again increases. The velocities within passage 44 and immediately above orifice 28 would have also increased. The pressure within suction tube 20 will experience suction due to the venturi effect. The pressure P1 is greater than the pressure at P2, which causes flow into and out of suction tube 20. Orifice 28 and/or restriction sleeve 48 can be sized to create the desired pressure draw down. The fluids and solids contained within well bore annulus 5 (and in well bore 92 within casing liner 86) will be suctioned into suction tube 20 via opening 90. The suction will be strong enough to suction fluids and solids contained within well bore annulus 5 (and in well bore 92 within casing liner 86) (see arrow "D"). Once the fluids and solids exit orifice 28, the fluids and solids will mix and become entrained with the medium or power fluid within the throat area denoted by the letter "T" and will be carried to the surface.

Jets 30, 32 are not required but if provided will also take a portion of the medium injected into micro annulus 40 and direct the medium into well bore annulus 5. This will aid in mixing and moving the fluids and solids within well bore annulus 5 (and well bore 92 within casing liner 86) and into suction tube 20.

It is possible to place a check valve (not shown) within suction tube 20. The check valve would prevent the fluids and solids from falling back down. Also, it is possible to make restriction sleeve 48 retrievable so that restriction sleeve 48 could be replaced due to the need for a more appropriate size, wear, and/or general maintenance. Moreover, the alternative embodiment may include an auger type device (not shown), which would be operatively associated with annular adapter 6. The auger device would revolve in response to the circulation of the medium which in turn would mix and crush the solids.

Figure 9:
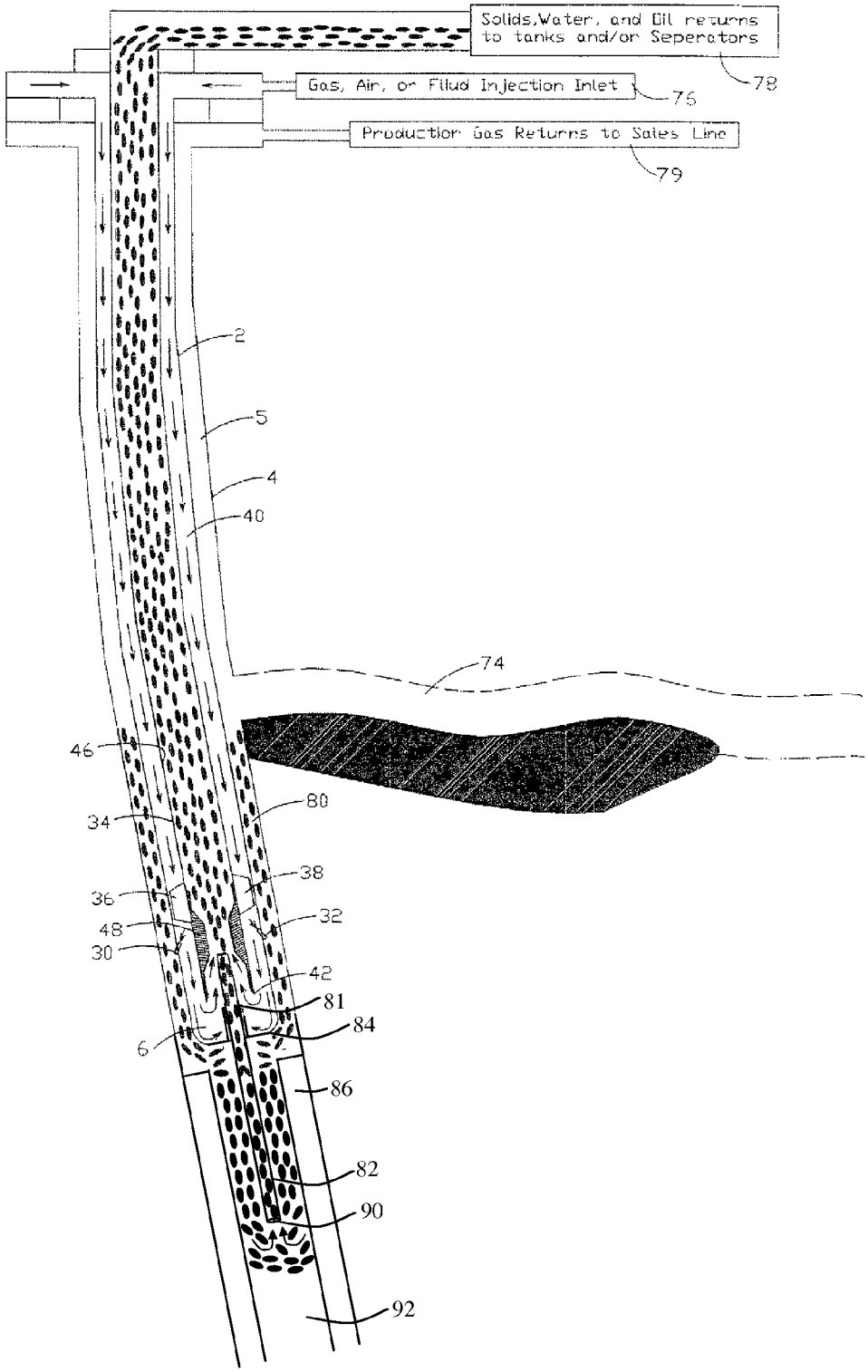
FIG. 9 is a schematic illustration of the alternative embodiment of the apparatus of the present invention in use in a well bore.

FIG. 9 is a schematic illustration of the alternative embodiment of the apparatus of the present invention in use in well bore 4 that includes casing liner 86. Well bore 4 intersects a natural gas deposit, which as shown in FIG. 9, is a coal-bed methane seam. As those of ordinary skill in the art will understand, for a coal-bed methane seam, bore hole 74 is drilled extending from well bore 4. As seen in FIG. 9, bore hole 74 is essentially horizontal. Bore hole 74 may be referred to as drainage bore hole 74. The methane gas embedded within the coal-bed methane seam will migrate. The gas first migrates to drilled bore hole 74. The gas then migrates into well bore 4 (which extends into well bore 92 within casing liner 86). While use in a coal-bed methane seam is described, it is to be understood that the alternative embodiment may be used in other applications. For instance, the natural gas deposit may be a subterranean hydrocarbon reservoir. The alternative embodiment may therefore be used in coal-bed methane seams as well as traditional oil and gas subterranean reservoirs. As would be understood to a skilled artisan, there is no need to drill a drainage bore hole for a subterranean hydrocarbon reservoir as the in-situ hydrocarbons will flow into well bore annulus 5 due to the permeability of the reservoir.

As seen in FIG. 9, first tubular member 2 (including annular adapter 6 and suction tube 20) and second tubular member 34 have been lowered into well bore 4 to a position where end 84 of adapter 6 is positioned within well bore 4 directly above the start of casing liner 86 which has a reduced or restricted ID as compared to the ID of well bore 4. Suction tube 20 has section 82, which extends downhole within casing liner 86. The medium is injected from the surface from generator means 76, e.g., a fluid pump or compressor means. The medium is forced (directed) down well bore 4. The medium flowing through the annular nozzle will cause suction within opening 90 of suction tube 20 so that the fluids and solids that have entered into well bore 4 (and within well bore 92 within casing liner 86) can be withdrawn.

The fluids and solids that enter into inner portion 46 of second tubular member 34 will be delivered to separator means 78 on the surface for separation and retention. As the fluids and solids are drawn down to a sufficient level within well bore 4, gas can migrate from the natural gas deposit into well bore 4. The gas can then be produced to the surface (via well bore annulus 5) to production facility means 79 for storage, transportation, sale, etc.

The alternative embodiment may be used in well bores that have smaller ID casing liners placed deeper inside the well bore. An example of such use would be the following configured well bore:

7⅝" production casing from 0 ft. to 4000 ft with ID of 6¾"
5½" liner from 3950 ft. to 6000 ft. with ID of 4¾"

With the well bore configured as described, the apparatus would be configured as follows:

tubular member 2 would have an OD of 5½" from 0 ft. to 3940 ft
section 82 of suction tube 20 would have an OD of 3½" or as small as 2⅜" and extend from 3940 ft. to 6000 ft.

The pressure drop and suction would be created inside of the apparatus at 3940 ft. The suction would be transmitted through suction tube 20 to outlet 90 at 6000 ft. Production fluid and formation fines would be sucked from 6000 ft. through suction tube 20 to tubular member 2 at 3940 ft. With the combination of the drive fluid at 3940 ft., the production fluids and formation fines would be lifted to the surface. The well bore could be a vertical, directional, or horizontal well bore.

As a second example, the well bore may be configured as follows:

7⅝" production casing from 0 ft. to 4000 ft with ID of 6¾"
5½" liner from 3950 ft. to 5000 ft. with ID of 4¾"
4¾" open hole from 5000 ft. to 6000 ft with ID of 4¾"

With the well bore configured as described, the apparatus would be configured as follows:

tubular member 2 would have an OD of 5½" from 0 ft. to 3940 ft.
section 82 of suction tube 20 would have an OD of 3½" or as small as 2⅜" and extend from 3940 ft. to 6000 ft.

The pressure drop and suction would be created inside of the apparatus at 3940 ft. The suction would be transmitted through suction tube 20 to outlet 90 at 6000 ft. Production fluids and formation fines would be sucked from 6000 ft. through suction tube 20 to tubular member 2 at 3940 ft. With the combination of the drive fluid at 3940 ft., the production fluid and formation fines would be lifted to the surface. The well bore could be a vertical, directional, or horizontal well bore.

As mentioned above, the alternative embodiment may be used at any depth and not be limited by surface injection pressures from the depth that tubular member 2 is placed with well bore 4. For example, well bore 4 could be configured as follows:

7⅝" production casing from 0 ft. to 6000 ft with ID of 6¾"
5½" liner from 5950 ft. to 7000 ft. with ID of 4¾"

The maximum injection pressure the surface equipment could sustain while providing drive fluid to tubular member 2 is 2500 psi. Accordingly, tubular member 2 cannot be run to a depth that would create pressure greater than 2500 psi, e.g., 5000 ft. The apparatus (without section 82) could only be run to a depth of 5000 ft. With the well bore configured as described, the apparatus (with section 82) would be configured as follows:

tubular member 2 would have an OD of 5½" from 0 ft. to 5000 ft.
section 82 of suction tube 20 would have an OD of 3½" or as small as 2⅜" and extend from 5000 ft. to 7000 ft.

The acceptable pressure drop and suction would be created inside of the apparatus at 5000 ft. The suction would be transmitted through suction tube 20 to outlet 90 at 7000 ft. Production fluids and formation fines would be sucked from 7000 ft. through suction tube 20 to tubular member 2 at 5000 ft. With the combination of the drive fluid at 5000 ft., the production fluids and formation fines would be lifted to the surface. The apparatus as so configured would keep the injection pressures at 2500 psi maximum required by the surface equipment. The well bore could be a vertical, directional, or horizontal well bore.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a review thereof.

What is claimed is:

1. An apparatus for suctioning fluids and solids from a well bore comprising:

a first tubular member disposed within said well bore forming a well bore annulus therein, said first tubular member having a first end and an inner portion;

a suction tube having an inner portion with an unobstructed circular flow area for passage of said fluids and solids within said well bore annulus, an outer portion, an internal section and an external section, said internal section of said suction tube extending into said inner portion of said first tubular member, said external section of said suction tube extending external of said first tubular member within a restricted section of said well bore annulus;

an annular adapter having an outer wall and an inner wall, said outer wall of said annular adapter threadedly connected to said first end of said first tubular member, said inner wall of said annular adapter threadedly connected to said suction tube at said internal section thereof; and a second tubular member concentrically disposed within said first tubular member forming a micro annulus therein for injection of a power fluid, said second tubular member having a first end and an inner portion, said first end of said second tubular member concentrically positioned about said outer portion of said suction tube at said internal section thereof to form an annular passage within said inner portion of said second tubular member for said power fluid.

2. The apparatus according to claim 1, wherein said external section of said suction tube has an outer diameter in the range of 2 inches to 4 inches.

3. The apparatus according to claim 2, wherein said external section of said suction tube has a length in the range of 1500 feet to 3000 feet.

4. The apparatus according to claim 3, wherein said suction tube comprises a plurality of tube segments threadedly connected together.

5. The apparatus according to claim 4, wherein said restricted section of said well bore is formed by a casing liner affixed within said well bore, by an open hole well bore having a smaller inner diameter than an outer diameter of said first tubular member, or by multiple well bores each having an inner diameter smaller than said outer diameter of said first tubular member.

6. The apparatus according to claim 1, further comprising a stabilizer means disposed about said second tubular member, said stabilizer means stabilizing said second tubular member within said first tubular member.

7. The apparatus according to claim 6, further comprising a jet means disposed within said first tubular member, said jet means delivering said power fluid from said micro annulus into said well bore annulus.

8. The apparatus according to claim 7, further comprising an inner tubing restriction sleeve disposed within said second tubular member, wherein a portion of said internal section of said suction tube extends into said inner tubing restriction sleeve.

9. The apparatus according to claim 8, further comprising an injection means, said injection means located at said surface of said well bore for injecting said power fluid into said micro annulus.

10. The apparatus according to claim 9, wherein said power fluid is selected from the group consisting of a gas, air, and a liquid.

11. A method of drawing down fluids and solids in a well bore, said well bore intersecting a hydrocarbon bearing deposit having a hydrocarbon, said method comprising the steps of:

a) providing an assembly comprising: a first tubular member, said first tubular member having a first end and an inner portion; a suction tube having an inner portion with an unobstructed circular flow area for passage of said fluids and solids within a well bore annulus, an outer portion, an internal section, and an external section, said internal section of said suction tube extending into said inner portion of said first tubular member, said external section of said suction tube extending external of said first tubular member; and an annular adapter having an outer wall and an inner wall, said outer wall of said annular adapter threadedly connected to said first end of said first tubular member, said inner wall of said annular adapter threadedly connected to said suction tube at said internal section thereof; and;

b) disposing said assembly within said well bore, said first tubular member forming a well bore annulus therein, said external section of said suction tube extending within a restricted section of said well bore;

c) disposing a second tubular member concentrically within said first tubular member forming a micro annulus therein for injection of a power fluid, said second tubular member having a first end and an inner portion, said first end of said second tubular member concentrically positioned about said outer portion of said suction tube at said internal section thereof forming an annular passage within said inner portion of said second tubing member for passage of said power fluid;

d) injecting said power fluid into said micro annulus;

e) channeling said power fluid through said annular passage;

f) causing an area of low pressure within said suction tube;

g) drawing down said fluids and solids contained within said well bore annulus into said suction tube;

h) discharging said fluids and solids from said suction tube into said inner portion of said second tubular member;

i) mixing said fluids and solids with said power fluid in said inner portion of said second tubular member;

j) discharging said mixture of said fluids, solids, and power fluid at a surface of said well bore.

12. The method according to claim 11, further comprising the steps of:

k) flowing said hydrocarbon from said hydrocarbon bearing deposit into said well bore annulus once a level of said fluids and solids in said well bore annulus is reduced to a predetermined level;

l) producing said hydrocarbon in said well bore annulus to a surface collection facility.

13. The method according to claim 12, wherein said external section of said suction tube has an outer diameter in the range of 2 inches to 4 inches.

14. The method according to claim 13, wherein said external section of said suction tube has a length in the range of 1500 feet to 3000 feet.

15. The method according to claim 14, wherein said suction tube comprises a plurality of tube segments threadedly connected together.

16. The method according to claim 15, wherein said restricted section of said well bore is formed by a casing liner affixed within said well bore, by an open hole well bore having a smaller inner diameter than an outer diameter of said first tubular member, or by multiple well bores each having an inner diameter smaller than said outer diameter of said first tubular member.

17. The method according to claim 16, wherein said well bore contains a sump area below a level of said hydrocarbon bearing deposit and a portion of said external section of said suction tube is positioned within said sump area.

18. The method according to claim 17, wherein said hydrocarbon bearing deposit is a natural gas or oil deposit.

19. The method according to claim 18, wherein said hydrocarbon bearing deposit is a natural gas deposit, said natural gas deposit being a coal-bed-methane seam.

20. The method according to claim 19, wherein said power fluid is selected from the group consisting of a gas, air, and a liquid.

* * * * *